US005115187A

United States Patent [19]

Hayashi

[11] Patent Number: 5,115,187

[45] Date of Patent: May 19, 1992

[54] WIDE DYNAMIC RANGE CURRENT SOURCE CIRCUIT

[75] Inventor: Shigeo Hayashi, Kanagawa, Japan

[73] Assignee: Sumitomo Electric Industries, Ltd., Osaka, Japan

[21] Appl. No.: 589,583

[22] Filed: Sep. 28, 1990

[30] Foreign Application Priority Data

Sep. 28, 1989 [JP] Japan ..... 1-252657

[51] Int. Cl.[5] ..... G05F 3/16

[52] U.S. Cl. ..... 323/315; 323/313; 307/296.6

[58] Field of Search ..... 323/313, 315, 316; 307/296.1, 296.6

[56] References Cited

U.S. PATENT DOCUMENTS

| | | | |
|---|---|---|---|
| 3,979,610 | 9/1976 | Gordon | 307/296.6 |
| 4,016,435 | 4/1977 | Vookman | 307/296.6 |
| 4,325,017 | 4/1982 | Schade, Jr. | 323/313 |
| 4,536,702 | 8/1985 | Nagano | 323/316 |
| 4,814,724 | 3/1989 | Tanigawa | 323/315 |
| 4,975,632 | 12/1990 | James et al. | 323/315 |
| 4,977,336 | 12/1990 | Martiny | 307/290 |

*Primary Examiner*—Steven L. Stephan
*Assistant Examiner*—Ben Davidson
*Attorney, Agent, or Firm*—Cushman, Darby & Cushman

[57] ABSTRACT

A wide dynamic range current source circuit comprising a first current mirror circuit including a first transistor functioning as a first output current path, and a second transistor for receiving a first control voltage and functioning as an input current path for controlling a current flowing in the output current path. The wide dynamic range current source circuit further comprises a second current mirror circuit including a third transistor functioning as a second output current path bypassing the input current path of the first current mirror circuit, and a fourth transistor for receiving a second control voltage different from the first control voltage and controlling a current of the second output current path. The second current mirror circuit controls current flow in the first mirror circuit such that this current flow is larger than a current flowing during a non-linear operation of the first current mirror circuit.

5 Claims, 4 Drawing Sheets

WIDE DYNAMIC RANGE CURRENT SOURCE CIRCUIT

BACKGROUND OF THE INVENTION

1. Field of the Invention

The present invention generally relates to a current source circuit, and particularly to the configuration of a novel current source circuit in which linearity of the characteristic can be kept in a wider range.

2. Prior Art

FIG. 1(a) shows an example of typical configuration of the conventional current source circuit.

As shown in the drawing, the circuit is constituted by an npn-type bipolar transistor $Q_{21}$ in which the collector is connected to an external input terminal EX, the base is connected to a control voltage $V_0$, and the emitter is connected to the ground GND through a resistor $R_0$, so that and a collector-emitter current I changes in accordance with a variation of the control voltage $V_0$.

FIG. 1(b) shows another example of the typical configuration of the conventional current source circuit.

As shown in the drawing, the circuit is constituted by a pair of npn-type bipolar transistors $Q_{22}$ and $Q_{23}$ and a resistor $R_0$, the respective bases of which are connected to each other. In this example, in the transistor $Q_{23}$, the collector and the base are shorted so as to make the transistor form a diode connection, the collector is connected to a control voltage $V_0$ through the resistor $R_0$, and the emitter is connected to the ground GND. In the transistor $Q_{22}$, on the other hand, the collector is connected to an external input terminal EX, and the emitter is connected to the ground GND. In this current source circuit, the transistors $Q_{22}$ and $Q_{23}$ constitute a current mirror circuit, and the configuration is made such that a collector-emitter current I in the transistor $Q_{22}$ changes in accordance with a variation of the control voltage $V_0$. FIG. 2 is a graph showing a general current-voltage characteristic of a bipolar transistor to be used in such a current source circuit as described above.

As shown in the graph of FIG. 2 (prior art), although the current-voltage characteristic of the bipolar transistor fundamentally has linearity, the characteristic is non-linear particularly in a region where the current value is small. In the conventional current source circuit constituted by transistors having such a characteristic, therefore, there has been a problem in that a substantial dynamic range is narrow because when the output current I becomes small, the linearity of the control characteristic is lost.

To cope with the foregoing problem, in accordance with an input, a control voltage V can be supplied to the current source circuit to thereby compensate for the non-linearity of the characteristic. Such a voltage supply circuit is however generally large in size so that the occupied area in an integrated circuit increases and the power consumption is large. Further, generally, such a circuit is significantly influenced by the scattering of the element characteristics, and therefore the proposal does not provide an effective solution for the above problem in an actual case.

SUMMARY OF THE INVENTION

It is therefore an object of the present invention to solve the foregoing problem in the prior art to provide a novel current source circuit in which the dynamic range is so wide that the linearity of the characteristic is kept even in a low level.

According to the present invention, there is provided a wide dynamic range current source circuit which comprises: a first current mirror circuit including a first transistor constituting an output side current path functioning as an output current path, and a second transistor connected so as to receive a first control voltage and constituting an input side current path for controlling a current flowing in the output current path. The current source circuit further comprises a second current mirror circuit including a third transistor constituting an output side current path connected so as to bypass the input side current path of the first current mirror circuit, and a fourth transistor connected so as to receive a second control voltage different from the first control voltage and constituting a current of the output side current path. The second current mirror circuit is configured so as to make a large current flow in comparison with a current flowing in a non-linear active region of the first current mirror circuit.

As described above, in a region where a large current flows, a voltage between the base and emitter of a transistor does not substantially change even if a current changes, and therefore the current linearly changes correspondingly to a change of the control voltage. If the control voltage is reduced so as to decrease the current, on the other hand, the voltage between the base and emitter of the transistor becomes low quickly, and the rate of the change of the current I to the change of the control voltage becomes slow. Therefore, in the conventional current source circuit, the voltage across a resistor element which would change linearly correspondingly to a control voltage does not change linearly in a small current region.

In the current source circuit according to the present invention, on the other hand, there is provided the second current mirror circuit connected to the collector of the transistor to which the control voltage is applied in the first current mirror circuit.

If a voltage to be applied to the control voltage input terminal of the second current mirror circuit is kept constant, a predetermined current is derived from the second current mirror circuit to the transistor in the input side current path of the first current mirror circuit, and therefore the voltage across the resistor element connected to the collector does not depend significantly on a change of the control voltage. Consequently, the non-linearity when the current becomes small is suppressed.

If the voltage to be applied to the control voltage terminal of the first current mirror circuit is kept constant and the control voltage is applied to the control voltage terminal of the second current source circuit, on the contrary, the current source circuit can be used as a current source circuit having a reverse characteristic, that is, a current source circuit in which an output current decreases when an applied voltage increases. The current source circuit can be used also as a differential current source circuit having a pair of control voltage terminals complementary to each other.

Further, in a constant-voltage regulated power supply circuit, generally, the temperature characteristic can be desirably set. It is however difficult to suppress the fluctuation in the output voltage when the supply voltage fluctuates. If it is intended to forcefully suppress the fluctuation of the output voltage, oscillation is apt to occur or the circuit size becomes large. In such a case, by connecting the control voltage input terminal of the second current mirror circuit to the power source and by connecting the control voltage input terminal of the first current mirror circuit to the constant-voltage circuit, the output current can be made to have a free temperature characteristic and the influence by the supply voltage fluctuation can be eliminated. Further, oscillation can be prevented from occurring in the constant-voltage regulated power supply circuit.

DETAILED DESCRIPTION OF THE PREFERRED EMBODIMENTS

The present invention will be described hereunder more specifically with reference to the accompanying drawings. The following disclosure, however, is no more than an embodiment of the present invention, and therefore the disclosure never limits the technical scope of the present invention.

Figure 1A:
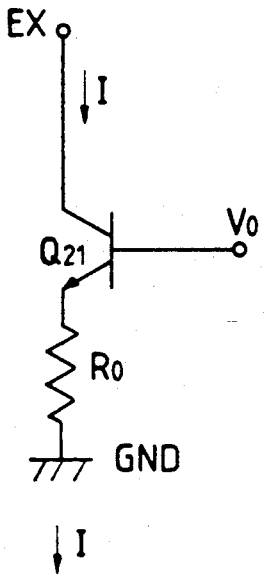
FIG. 1(a) (PRIOR ART)
FIGS. 1(a) and 1(b) (both prior art) are diagrams showing the typical configurations of the conventional current source circuit.
Figure 1B:
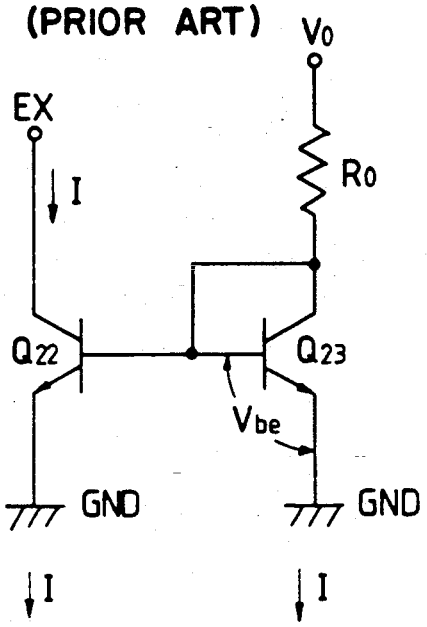
FIG. 1(b) (PRIOR ART)
Figure 2:
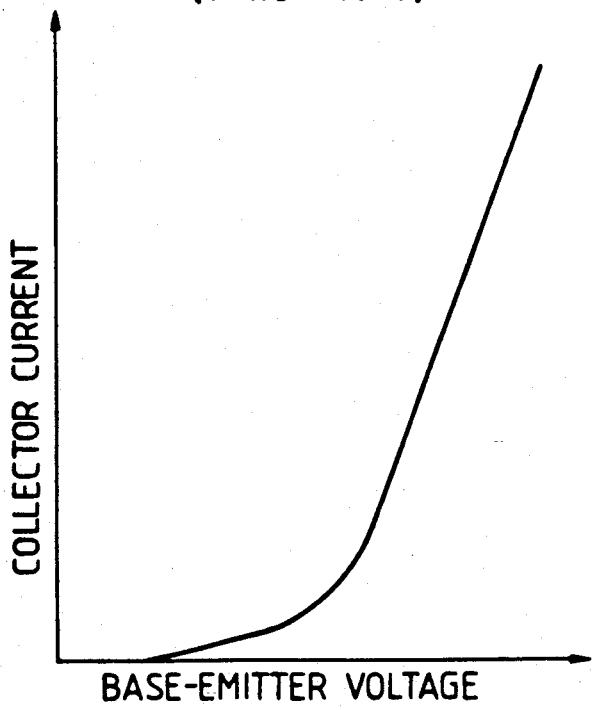
FIG. 2 (PRIOR ART)
FIG. 2 (prior art) is a graph showing a general current-voltage characteristic of a transistor.
Figure 3:
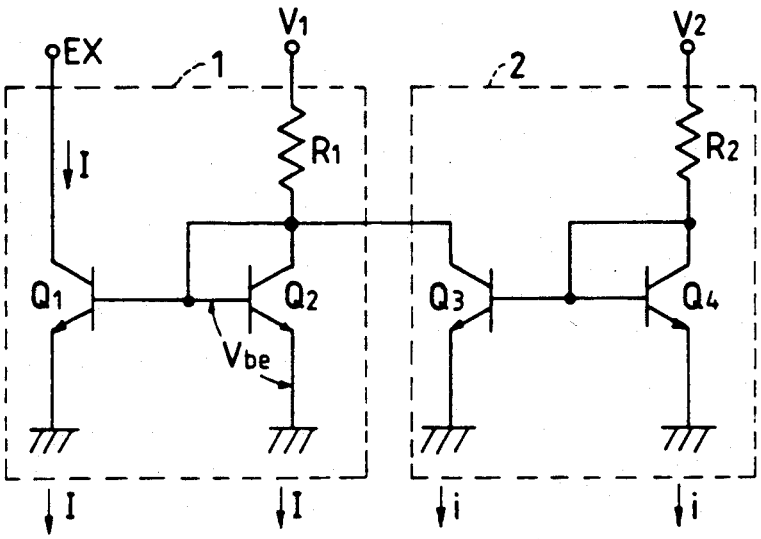
FIG. 3 is a circuit diagram showing the fundamental configuration of the current source circuit according to the present invention.

FIG. 3 is a circuit diagram showing a specific example of the configuration of the current source circuit according to the present invention.

As shown in the drawing, the circuit comprises a pair of current mirror circuits, that is, first and second current mirror circuits 1 and 2.

In this configuration, the first current mirror circuit 1 comprises a pair of npn-type bipolar transistors $Q_1$ and $Q_2$ and a resistor $R_1$, the respective bases of which are connected to each other. In the transistor $Q_1$, the collector is connected to an external input terminal EX and the emitter is connected to the ground GND. In the transistor $Q_2$, on the other hand, the collector and the base are shorted to each other so as to make the transistor form a diode connection, the collector is connected to a control voltage $V_1$ through the resistor $R_1$, and the emitter is connected to the ground GND.

Further, the second current mirror circuit 2 comprises a pair of npn-type bipolar transistors $Q_3$ and $Q_4$ and a resistor $R_2$, the respective bases of which are connected to each other. In the transistor $Q_3$, the collector is connected between the collector of the transistor $Q_2$ and the resistor $R_1$ in the first current mirror circuit, and the emitter is connected to the ground GND. In the transistor $Q_4$, on the other hand, the collector and the base are shorted to each other so as to make the transistor form a diode connection, the collector is connected to a control voltage $V_2$ through the resistor $R_2$, and the emitter is connected to the ground GND.

Next, description will be made as to the operation of the circuit in the case where the control voltage $V_2$ is kept constant and a control voltage is applied to the control voltage $V_1$.

A base-emitter voltage $V_{be}$ in the transistor $Q_2$ does not substantially change in a region where are operating current I takes an ordinary value, and, therefore, first, when the control voltage $V_1$ is reduced, the current I becomes small linearly in accordance with the change of the control voltage $V_1$.

Further, if the control voltage $V_1$ is reduced gradually so as to obtain a smaller current, a range where the base-emitter voltage in the transistor $Q_2$ changes is reached soon. In the current source circuit according to the present invention, however, a current is derived by the transistor $Q_3$ of the second current mirror circuit 2 provided in parallel to the transistor $Q_2$. Since the control voltage $V_2$ of the second current mirror circuit 2 is kept constant as described above, also the current I derived by the $Q_3$ of the second current mirror circuit 2 is constant. Therefor, even in a region where the current I is small, a change of the voltage across the resistor $R_1$ does not depend on the change of the control voltage $V_1$. Thus, the non-linearity of characteristic can be suppressed in a small current region of operation.

Although only the fundamental configuration of the current source circuit is shown in FIG. 3, a control voltage fine-adjustment function or an oscillation prevention function can be provided by connecting resistor elements or capacity elements to the collectors or the bases of the transistors in addition to the fundamental configuration.

Figure 4:
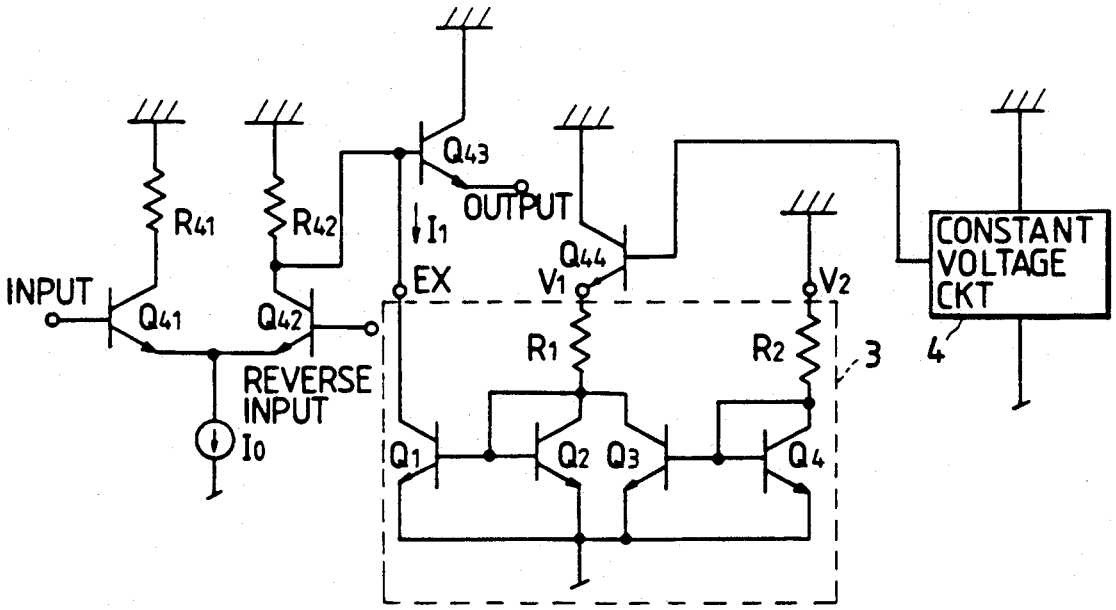
FIG. 4 is a circuit diagram showing the circuit configuration in the case where the current source circuit according to the present invention is applied to an ECL circuit.

FIG. 4 is a circuit diagram showing an example of configuration of an ECL circuit using the current source circuit of FIG. 3 according to the present invention.

That is, in this circuit, a current source $I_1$ is connected to the output terminal of the ECL circuit so as to hold an H level output of the ECL circuit constant, and the current source circuit 3 of FIG. 3 according to the present invention is used as the current source $I_1$.

The ECL circuit is constituted by a pair of transistors $Q_{41}$ and $Q_{42}$ the respective collectors of which are connected to the ground GND through resistors $R_{41}$ and $R_{42}$ respectively and the respective emitters of which are connected to each other and connected to a low voltage power source through a current source $I_0$. The respective bases of the transistors $Q_{41}$ and $Q_{42}$, on the other hand, are connected to differential input terminals, respectively. Further, a transistor $Q_{43}$ has a base connected between the collector of transistor $Q_{42}$ and the resistor $R_{42}$, a collector connected to the ground GND, and an emitter is made to be the output terminal.

On the other hand, the external input terminal EX and the control voltage terminal $V_2$ of the current source circuit 3 are connected to the base of the transistor $Q_{43}$ and the ground GND respectively. Further, the control voltage terminal $V_1$ of the current source circuit 3, on the other hand, is connected to the emitter of a transistor $Q_{44}$. The collector and base of the transistor $Q_{44}$ are connected to the ground GND and a constant-voltage regulated power supply circuit 4 respectively.

In this case, a realized is a state where a control voltage is applied to the control voltage terminal $V_1$ of the first current mirror circuit in the current source circuit 3 and a fixed voltage is applied to the control voltage terminal $V_2$ of the second current mirror circuit. Generally, it is required for such an ECL circuit that the fluctuation in a supply voltage is small and the output current $I_1$ changes linearly from 10 $\mu$A to 1 $\mu$A depending on a temperature. In the foregoing circuit, the requirement could be actually satisfied. Further, oscillation of the constant-voltage regulated power supply circuit was effectively prevented from occurring, and the circuit received no influence by the fluctuation of the power source.

Figure 5A:
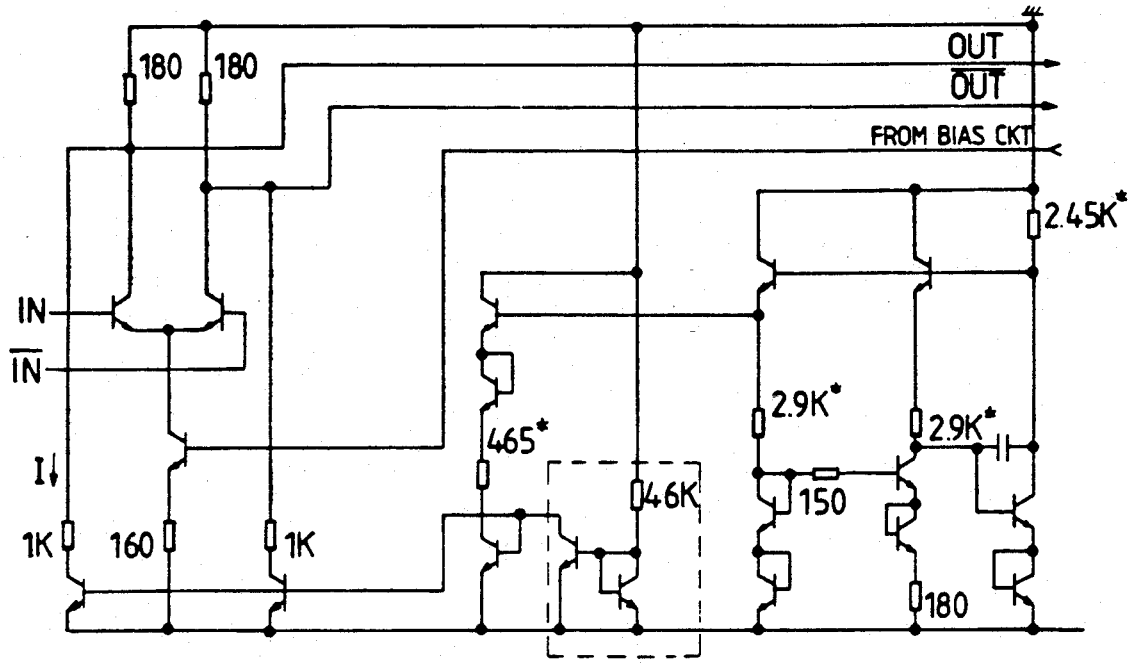
FIGS. 5(a) and 5(b) are a concrete example of current source circuit according to the present invention, and the relationship between the constant current and the temperature, respectively.
Figure 5B:
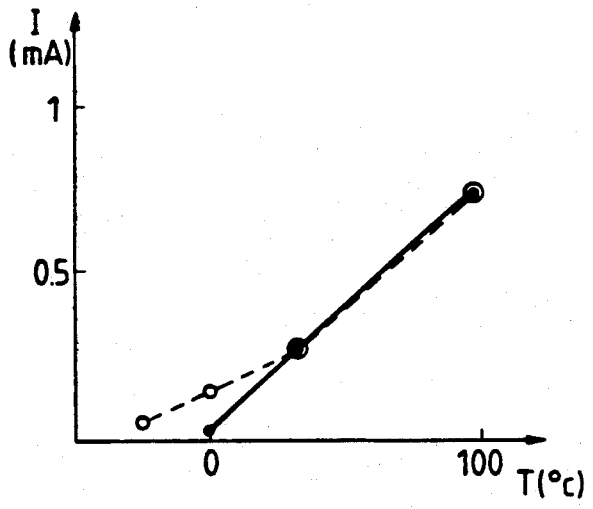

FIGS. 5(a) and 5(b) shows a concrete example of the wide dynamic range current source circuit according to the present invention, and the relationship between the constant current I and the temperature T, respectively. In FIG. 5(b), a solid line characteristic is obtained by using the circuit of FIG. 5(a), whereas a dotted line characteristic is obtained by using the circuit in which the elements surrounded by a dotted line block is deleted from the circuit of FIG. 5(a).

Although the current source circuit according to this embodiment is constituted by bipolar transistors, the current source circuit according to the present invention can be constituted by using FETs in the same manner as in the case of using bipolar transistors. That is, the transistors Q1 and Q2, Q3 and Q4, or Q1 through Q4 of FIG. 3 may be replaced by FETs, respectively. This fact is apparent to those skilled in the art with no necessity of specific description.

Figure 6:
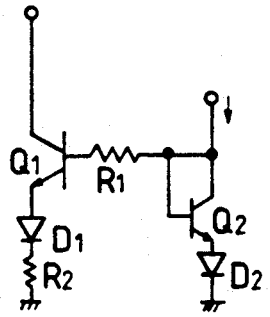
FIG. 6 is a modified embodiment of the present invention.
Figure 7:
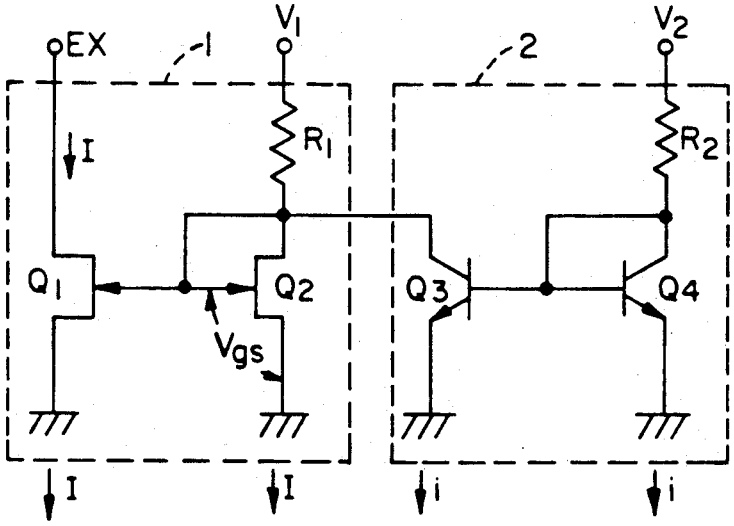
FIG. 7 is the circuit diagram of FIG. 3 with the first and second transistors being FETS.
Figure 8:
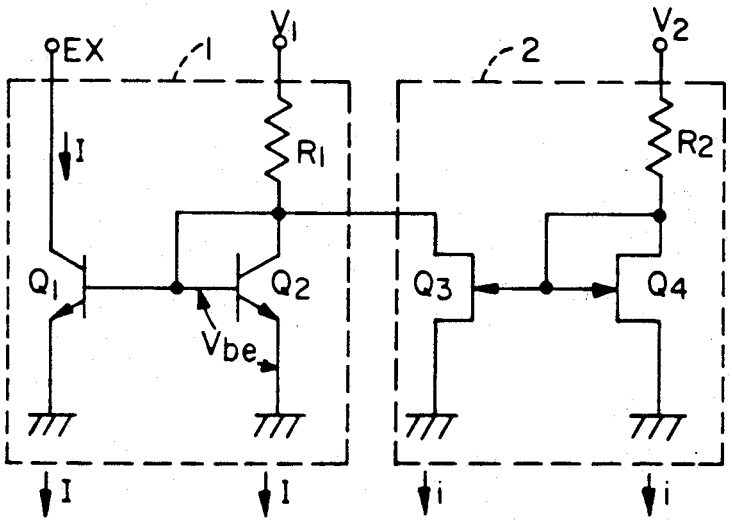
FIG. 8 is the circuit diagram of FIG. 3 with the third and fourth transistors being FETS.
Figure 9:
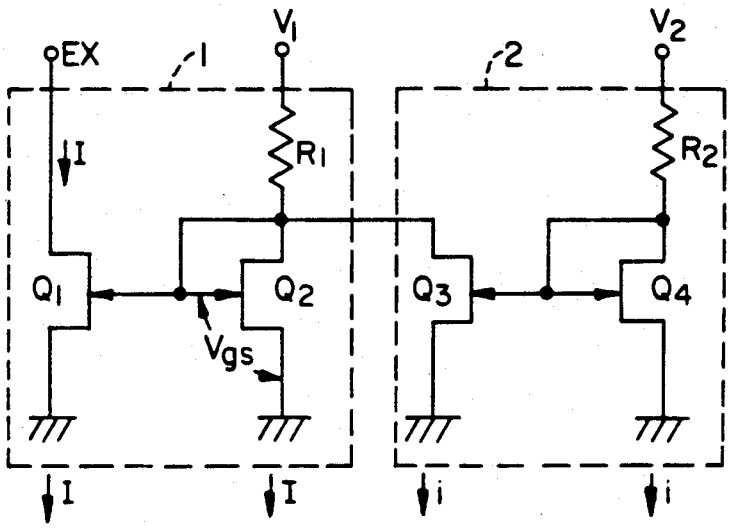
FIG. 9 is the circuit diagram of FIG. 3 with all transistors being FETS.

Further, the current mirror circuit employed in the above embodiment may be provided with, for example, diodes D1 and D2 and resistors R1 and R2, as shown in FIG. 6.

As described above, the current source circuit according to the present invention does not lose the linearity of characteristic in a low current region. Further, the number of constituent elements is decreased, and therefore in an integrated circuit, the occupied area and the power consumption can be reduced. Consequently, the current source circuit according to the present invention can be effectively applied as a broad dynamic range current source circuit to constituent elements of an integrated circuit.

What is claimed is:

1. A wide dynamic range current source circuit, comprising:

a first current mirror circuit comprising:

a first transistor providing a first output current path, and a second transistor for receiving a first control voltage, said second transistor providing an input current path for controlling a current flow in said output current path; and a second current mirror circuit comprising:

a third transistor providing a second output current path, said third transistor bypassing said input current path of said first current mirror circuit, and a fourth transistor for receiving a second control voltage different from said first control voltage and controlling a current of said second output current path, said second current mirror circuit controlling a current flow in said first current mirror circuit, said current flow in said first current mirror circuit being larger than a current flowing during non-linear operation of said first current mirror circuit.

2. A current source circuit according to claim 1, wherein said first transistor is a first bipolar transistor, a collector of said first transistor being coupled to an output terminal and an emitter of said first transistor being coupled to a low voltage, said second transistor is a second bipolar transistor, a collector of said second transistor being coupled to a first control voltage input terminal through a first resistor, an emitter of said second transistor being coupled to said low voltage, a base of said second transistor being coupled to said collector of said second transistor and said base of said first transistor, said third transistor is a third bipolar transistor, a collector of said third transistor being coupled to said collector of said second transistor, an emitter of said third transistor being coupled to said low voltage, and said fourth transistor is a fourth bipolar transistor, a collector of said fourth transistor being coupled to a second control voltage input terminal through a second resistor, an emitter of said fourth transistor being coupled to said low voltage, and a base of said fourth transistor being coupled to said collector of said fourth transistor and to a base of said third transistor.

3. A current source circuit according to claim 1, wherein said first and second transistor each is an FET.

4. A current source circuit according to claim 1, wherein said third and fourth transistor each is an FET.

5. A current source circuit according to claim 1, wherein said first, second, third and fourth transistor each is an FET.

* * * * *